United States Patent [19]

Meyer

[11] 3,980,302

[45] Sept. 14, 1976

[54] SURFACE PROJECTILE GAME DEVICE

[75] Inventor: Burton C. Meyer, Downers Grove, Ill.

[73] Assignee: Marvin Glass & Associates, Chicago, Ill.

[22] Filed: May 8, 1975

[21] Appl. No.: 575,793

[52] U.S. Cl. ..... 273/87.2; 273/120 R; 273/125 R; 273/129 F

[51] Int. Cl.[2] ..... A63F 7/06; A63F 7/10; A63F 7/14

[58] Field of Search ..... 273/87 R, 87 E, 87.2, 273/120, 122, 125, 126, 129 F

[56] References Cited

UNITED STATES PATENTS

| | | | |
|---|---|---|---|
| 575,247 | 1/1897 | Kiah | 273/120 R X |
| 657,522 | 9/1900 | Deiters et al. | 273/120 R |
| 1,573,415 | 2/1926 | Mendes et al. | 273/122 R X |
| 1,644,514 | 10/1927 | Dietrichs | 273/120 R |
| 1,714,905 | 5/1929 | Dieterich | 273/125 R |
| 1,939,819 | 12/1933 | Isaza | 273/125 R |
| 1,983,044 | 12/1934 | Maynard | 273/125 R |
| 2,815,213 | 12/1957 | Wisener | 273/122 R X |
| 3,647,213 | 3/1972 | Baker | 273/120 R X |
| 3,712,620 | 1/1973 | Goldfarb et al. | 273/120 R |
| 3,884,469 | 5/1975 | Morton | 273/87.2 |

*Primary Examiner*—Paul E. Shapiro
*Attorney, Agent, or Firm*—Coffee & Sweeney

[57] ABSTRACT

A ball rolling game apparatus simulating a golf tee. The game apparatus includes a game board having a downwardly inclined starting ramp with ball guides thereon, and a playing surface forming a continuation of the ramp with a ball receiving aperture therein. An obstacle such as a simulated golf pin is disposed in front of the aperture, requiring the skill of a player to roll a ball down the ramp, across the playing surface, and around the obstacle into the aperture. A return trough surrounds the playing surface so that a ball which is projected down the ramp "off target" or too fast, will fall off of the playing surface into the trough. A pivotally operated ball return lever is provided to permit the player to raise the ball out of the aperture into the return trough thereby facilitating the repossession of the ball by the player. In the exemplary embodiment, the playing surface is inclined downwardly back toward the ramp and is concave in cross section.

4 Claims, 4 Drawing Figures

SURFACE PROJECTILE GAME DEVICE

SUMMARY OF THE INVENTION

This invention relates to skill-type games, and particularly to a ball rolling or surface projectile game simulating play on a golf green, or the like.

In the exemplary embodiment, an elongated game board is provided with a ramp portion at one end and a playing surface at the other end, the playing surface being substantially longer than the ramp portion. The ramp portion and playing surface are inclined downwardly toward each other, but with the ramp portion at a greater angle. The playing surface is generally concave in cross section.

The playing surface portion of the game board has an aperture near, but spaced from, the end thereof opposite the ramp portion. An obstacle in the form of a golf hole pin is provided on the playing surface in front of the aperture, between the aperture and the ramp portion. A plurality of guide rails protrude upwardly from the ramp portion for guiding a ball downwardly therealong onto the playing surface whereby a player attempts to launch or propel a ball down the ramp portion over the inclined and concave playing surface around the obstacle into the aperture. The periphery of the playing surface has a drop-off into a return trough where a ball which is rollingly propelled down the ramp portion onto the playing surface "off target" or at too fast a rate of speed, will drop off the playing surface into the trough and be returned toward the shooting player. A lever member is pivotally mounted beneath the playing surface and has an upwardly protruding portion subjacent the aperture in the playing surface for ejecting a ball from the aperture into the return trough for return to the player after a successful "shot".

Other objects, features and advantages of the invention will be apparent from the following detailed description taken in connection with the accompanying drawings.

DETAILED DESCRIPTION OF THE INVENTION

Figures 1, 2, 3, 4:
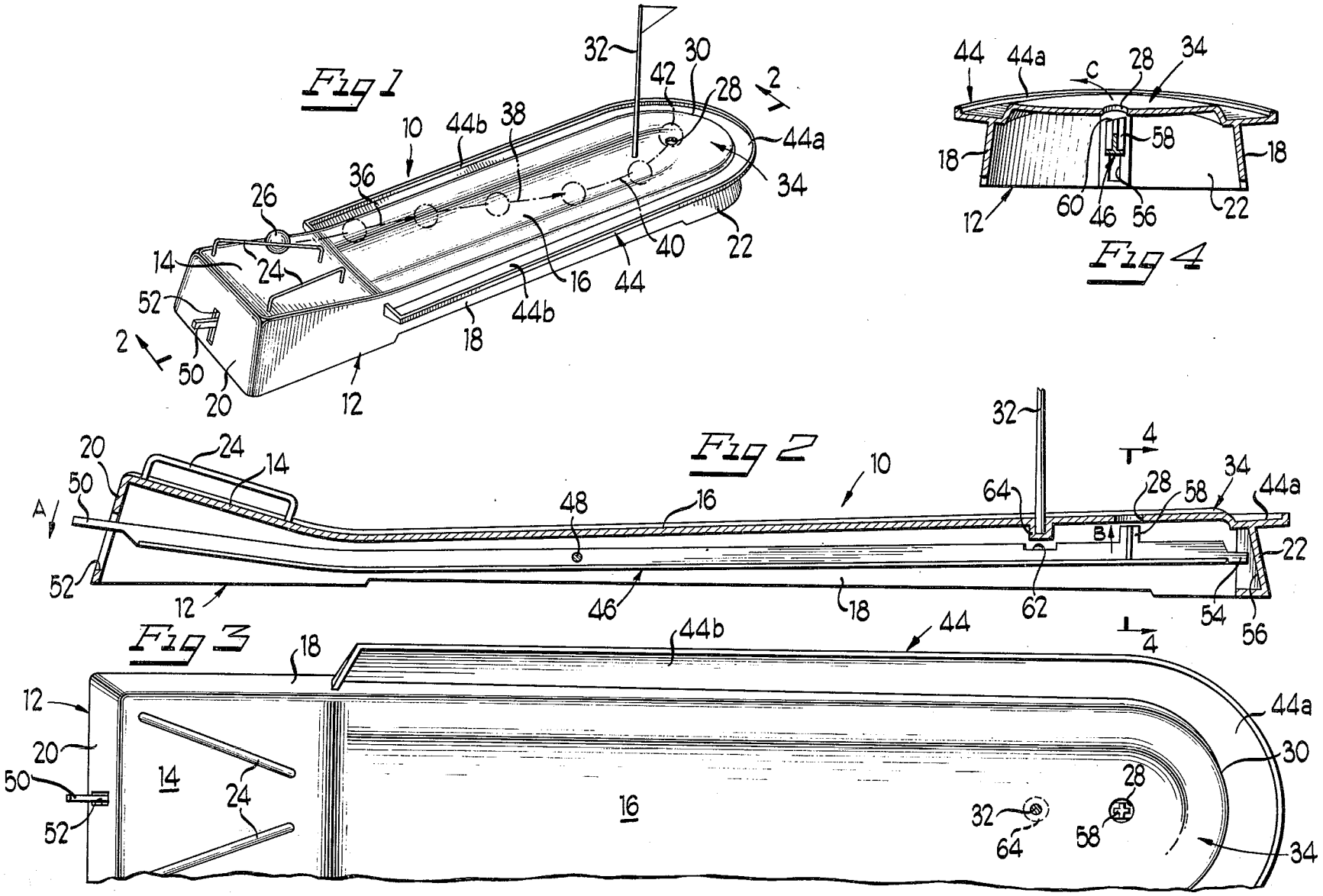
FIG. 1 is a perspective view of the game apparatus of the present invention, showing in phantom one path of travel of a ball along the game board.
FIG. 2 is a section view, on an enlarged scale, taken approximately along line 2—2 of FIG. 1.
FIG. 3 is a fragmented top plan view, on an enlarged scale, of the game board of FIG. 1.
FIG. 4 is a section taken approximately along line 4—4 of FIG. 2.

Referring to the drawings in greater detail, the game apparatus of the present invention, generally designated 10, includes an upstanding frame, generally designated 12, which has raised surface means defining a starting position in the form of a ramp 14, and a playing surface 16, the latter being provided to simulate a golf green. The ramp 14 and playing surface 16, as best seen in FIG. 2, are inclined or sloped downwardly toward each other, but with the ramp 14 being inclined at a greater angle than the playing surface 16. The ramp portion 14 and playing surface 16 are disposed in the aforesaid raised position by the frame 12 which includes a pair of side walls 18, a flat end wall 20 facing a player of the game, and an arcuate end wall 22 at the end of the game board opposite the flat end wall 20. In this fashion, the underside of the frame is generally hollow as seen in FIG. 2 with the ramp 14 and playing surface 16 disposed above a supporting surface, such as a table top. A pair of inverted U-shaped guide rails 24, of rod stock or the like, protrude upwardly from the ramp 14 in a mutually converging direction toward the playing surface 16 to facilitate guiding a ball 26 rollably down the ramp 14 and onto the playing surface 16 as indicated in phantom in FIG. 1.

An aperture 28 is formed in the playing surface 16 at the end thereof opposite the ramp 14, but spaced inwardly from the marginal arcuate periphery 30 at that end of the playing surface. A simulated golf hole pin or flag 32 is mounted on and protrudes upwardly from the playing surface 16 between the aperture 28 and the ramp 14.

As best seen in FIG. 4, the playing surface is concave in cross section and merges into a mildly sloped, semiconical portion, generally designated 34, between the aperture 28 and the end of the playing surface 16. In this manner, any section through the playing surface 16 will provide some form of curvilinear shape along which the ball 26 must roll from the ramp 14 toward the aperture 28. For instance, one path of travel of the ball 26 is shown in phantom in FIG. 1 where it can be seen that the ball rolls down the ramp 14 and moves onto the lefthand side of the playing surface 16 (as viewed by the shooting player) at an upper portion of the concave cross section thereof, as at 36, and proceeds across a low point of the playing surface, as at 38, and proceeds upwardly along the righthand side of the concave surface, as at 40, in a path of travel toward the aperture 28. If accurate, the ball will seat in the aperture, as at 42. In this manner, the ball will curve around the obstacle or golf pin 32 toward the aperture. Of course, many different paths of travel are possible in utilizing the invention by rolling the ball 26 down the ramp 14 and over the curvilinearly shaped playing surface 16.

As seen in FIG. 2, the ramp 14 also is slightly concave to permit initiating a curved path of travel for the ball.

Should a ball 26 be successfully propelled into the aperture 28, means is provided for manual manipulation in front of the ramp 14 for returning the ball back to the player. More particularly, a return trough, generally designated 44, is provided about the periphery of the playing surface 16 along the frame side walls 18 and end wall 22 below the playing surface 16 to provide a drop-off therefrom into the return trough. The return trough has an arcuate portion **44*a* bounding the semiconical surface portion 34 and a pair of side trough portions 44*b* which, as seen in FIG. 1, slope downwardly toward the ramp 14 whereby a ball can be retrieved from the ends of the side trough portions 44*b*. A lever member, generally designated 46 (see FIG. 2), is pivotally mounted within the frame on a pivot pin 48. Due to the longer moment arm of the lever member being disposed on the righthand of the pivot pin 48, as viewed in FIG. 2, gravity will maintain the lever in the position shown. The lever member has a handle portion 50 exposed exteriorly of the frame 12 through an aperture 52 in the frame end wall 20 in front of the ramp 14. The extreme opposite end of the lever member 46 has a tab portion 54 which is disposed within and guided by a slot 56 which is vertically oriented within and formed by the frame 12. An upstanding boss 58 is formed on the upper side of the lever 46 beneath the aperture 28**.

In this manner, a player may depress the handle portion 50 of the lever member 46 in the direction of arrow A (FIG. 2) and have the boss portion 58 move upwardly in the direction of arrow B (FIG. 2) into the aperture 28 and eject a ball therefrom. Referring to FIG. 4, it can be seen that the top of the boss 58, as at 60, is canted so that the boss has a tendency to eject a ball in the direction of arrow C (FIG. 4) into the return trough 44. Referring back to FIG. 2, it can be seen that the lever 46 has a cutout 62 to accommodate a boss 64 on the underside of the playing surface 16 within which the obstacle or pin 32 is mounted.

Not only is the return trough 44 provided for the return of a ball ejected from the aperture 28, but it is readily apparent that a ball which is rolled down the ramp 14 onto the playing surface 16 "off target" or at a rate of speed too fast to be maintained on the playing surface 16 by the curvilinear shape thereof, will drop off the playing surface into the trough for return of the ball (or a penalty, or the like, in accordance with the rules of the game).

The foregoing detailed description has been given for clearness of understanding only and no unnecessary limitations should be understood therefrom as some modifications will be obvious to those skilled in the art.

I claim:

1. A toy golf game apparatus, comprising, in combination:

a frame defining a game board having a stationary, inclined ramp portion disposed at a predetermined angle leading downwardly to and adjoining a curvilinear playing surface which is concave in cross section over a substantial portion thereof, said playing surface ending in a semi-conical portion at the end thereof opposite said ramp, said playing surface being inclined downwardly back toward said ramp at an angle smaller than said predetermined angle;

an aperture defined in said playing surface between said ramp portion and said semi-conical portion;

an upstanding obstacle on said playing surface between the aperture and the ramp portion;

a rollable playing piece for projection down the ramp portion by a player of the game onto said playing surface for movement thereover along the curvilinear shape thereof in an attempt to roll around said obstacle into said aperture;

guide rail means on said ramp portion to facilitate aiming of said rollable playing piece down the ramp portion onto the playing surface;

a generally contiguous playing piece return trough circumscribing said playing surface and sloped downwardly toward said ramp portion for returning the rollable playing piece back to a player at said ramp portion should it roll off of said playing surface into said trough; and means for ejecting a playing piece from said aperture, including a selectively actuatable lever extending through the frame below the ramp portion to facilitate return of a rollable playing piece by a player at said ramp portion.

2. The game apparatus of claim 1 wherein said means for ejecting a playing piece from the aperture includes means for pivotally mounting the lever so that the weight thereof retains the lever in a retracted position out of engagement with a rollable playing piece in said aperture and moves the lever back to the retracted position after a rollable playing piece has been ejected from the aperture.

3. The game apparatus of claim 2 wherein said obstacle comprises a simulated golf pin mounted in said playing surface at a predetermined distance between said aperture and said ramp.

4. The game apparatus of claim 3 wherein said rail guide means comprises a pair of individual upwardly directed U-shaped rails positioned on said ramp portion to facilitate aiming of the rollable playing piece across the playing surface.

* * * * *